United States Patent [19]

Lin et al.

[11] Patent Number: 4,924,918

[45] Date of Patent: May 15, 1990

[54] MACHINE FOR MANUFACTURING BUTTON CONNECTOR AND METHOD THEREFOR

[76] Inventors: Ming-fang Lin; C. H. Cheng, both of Room 7, 17 Fl., No. 955, Tunhwa S. Rd., Taipei, Taiwan

[21] Appl. No.: 324,733

[22] Filed: Mar. 17, 1989

[51] Int. Cl.[5] ..... B21F 7/00

[52] U.S. Cl. ..... 140/102; 140/149; 242/53; 29/874; 72/295

[58] Field of Search ..... 72/295, 299, 371, 372, 72/338; 140/102, 104, 92.1, 71 R, 71 C, 149; 242/53; 29/874

[56] References Cited

U.S. PATENT DOCUMENTS

| | | | |
|---|---|---|---|
| 1,461,705 | 7/1923 | Dunham | 242/53 |
| 1,910,323 | 5/1933 | Cunnington | 140/71 R |
| 3,732,379 | 5/1973 | Focharile | 29/874 |
| 4,351,092 | 9/1982 | Sebring et al. | 242/53 |
| 4,432,501 | 2/1984 | Arendt et al. | 242/53 |
| 4,632,156 | 12/1986 | Whellams | 242/53 |

*Primary Examiner*—Daniel C. Crane
*Attorney, Agent, or Firm*—Thomas S. Keaty

[57] ABSTRACT

A machine and method for manufacturing "fuzz button" type button connectors. The machine has a mechanism for supplying wire and a mechanism for knurling the same wire. The machine also includes a mechanism for wrapping the wire around two temporarily fixed points and a mechanism for spinning one of the two fixed points. After wrapping and spinning, the wire is cut at both end portions and ejected.

10 Claims, 10 Drawing Sheets

FIG. 10A
FIG. 10B
FIG. 10C
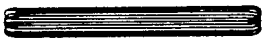
FIG. 10D
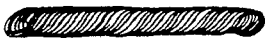

MACHINE FOR MANUFACTURING BUTTON CONNECTOR AND METHOD THEREFOR

BACKGROUND OF THE INVENTION

This invention relates to a machine and method for manufacturing button connectors which are in the form of a wad of crumpled wire. This type of button connector is also called the "fuzz button".

The button connector produced in this invention uses fine, springy, highly conductive wire to make minuscule connectors that are pressed into holes in insulating boards. This wire material has been around for many years and is essentially the same as the finely woven wire mesh used to control electromagnetic interference in highly sensitive radio frequency equipment.

It is widely known that a large amount of electronic system malfunctions are caused by failures at interconnection points. Solder joints are highly vulnerable to temperature cycling and to vibration and shock. Multiprong chips and board-edge connectors (which contain many solder joints) are also vulnerable to mechanical wear and breakage.

The button connector is a substantially cylindrical wad of wire, approximately 0.050" in diameter and the same in overall length. It protrudes approximately 0.005" to 0.010" at each end so that when compressed, its springiness keeps it in place and establishes excellent contact at both ends.

By controlling the length of wire that is wadded into each button connector (and, of course, the thickness of the board and size of the holes), button density and therefore transmissivity and the resultant compression force can be precisely specified and maintained within close tolerances. At the same time, over-compression, accidental bending, high-insertion forces, wearout, and breakage—problems that plague conventional prong and finger connectors—are completely eliminated.

The machine of this invention incorporates actuating means, such as motors and air cylinders, which respond to actuate a plurality of independent means to rotate, revolve, spin or translate. The machine comprises a wire supply means for supplying the wire to be knurled by a knurling means. The knurled wire is then guided to wrap a specified number of turns around first and second protruding needles. The wrapped wire is again spun with reference to a longitudinal axis thereof, with the second protruding needle fixed, to form a substantially helical shape.

SUMMARY OF THE INVENTION

It is, therefore, an object of the present invention to provide an effective machine and novel method for manufacturing button connector.

These and additional objects, if not set forth specifically herein, will be readily apparent to those skilled in the art from the detailed description provided hereinbelow, with appropriate reference to the accompanying drawings.

BRIEF DESCRIPTION OF THE DRAWINGS

FIGS. 10A through 10D are respective simplified views showing progressive stages of production of the wire used in button connectors in accordance with the present invention.

DETAILED DESCRIPTION OF THE PREFERRED EMBODIMENT

Figure 1:
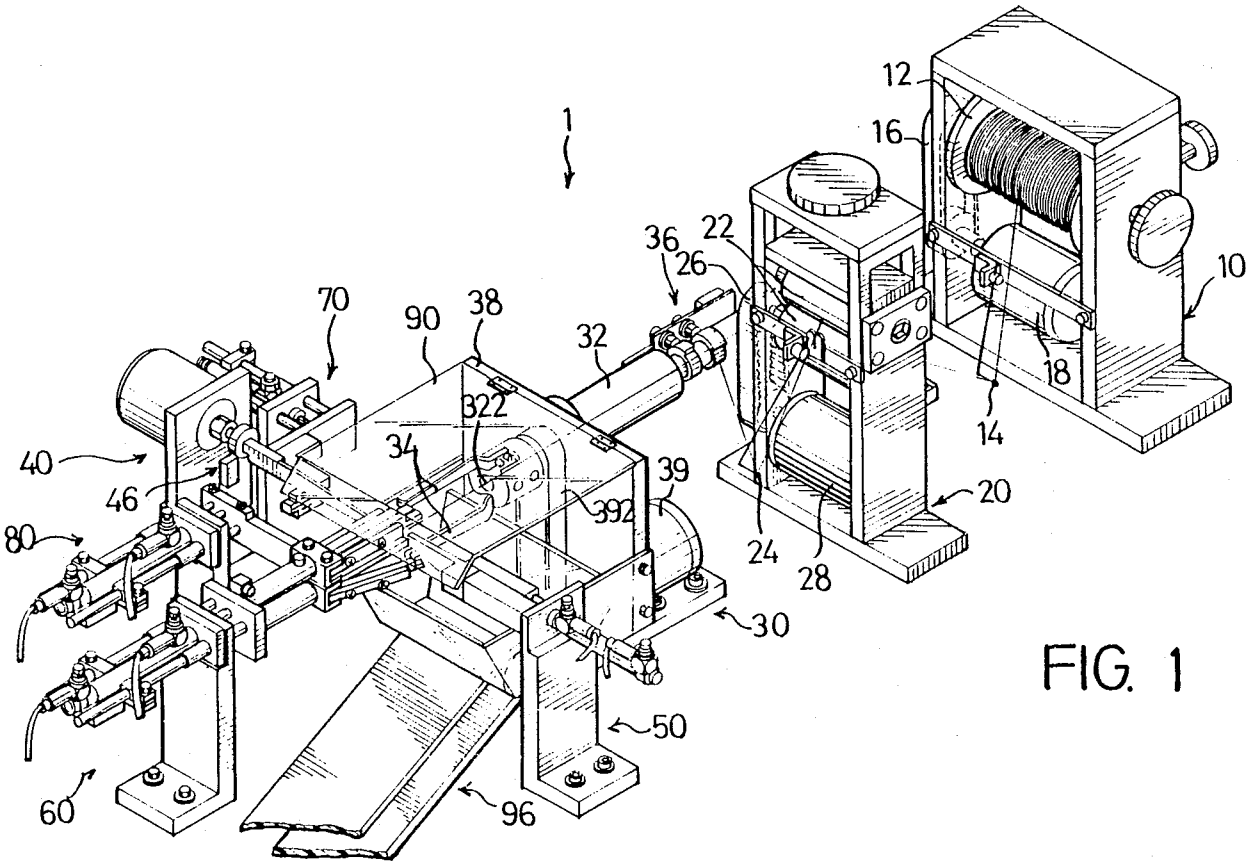
FIG. 1 is a perspective view of a machine for manufacturing button connectors in accordance with the present invention.
Figure 2:
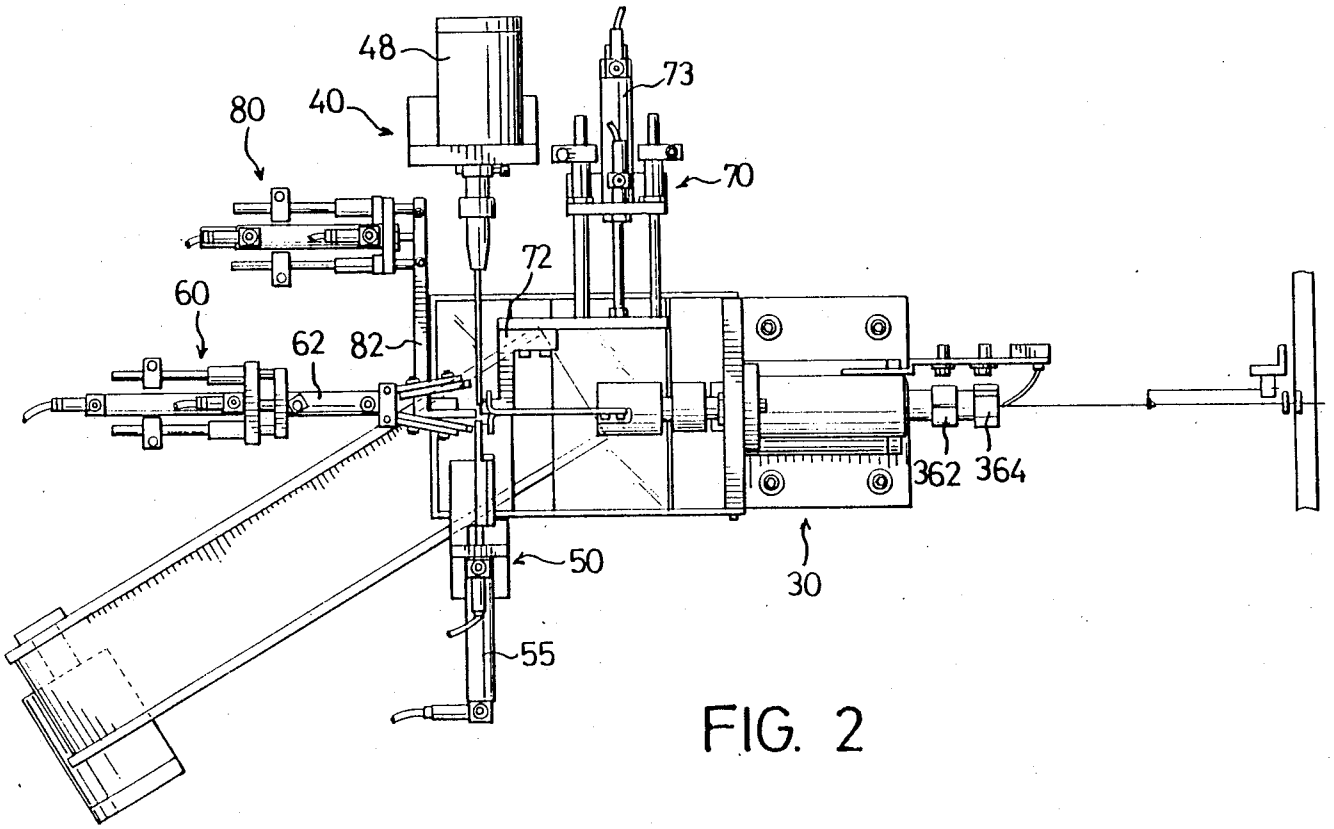
FIG. 2 is a top plan view of the machine of FIG. l.
Figure 4:
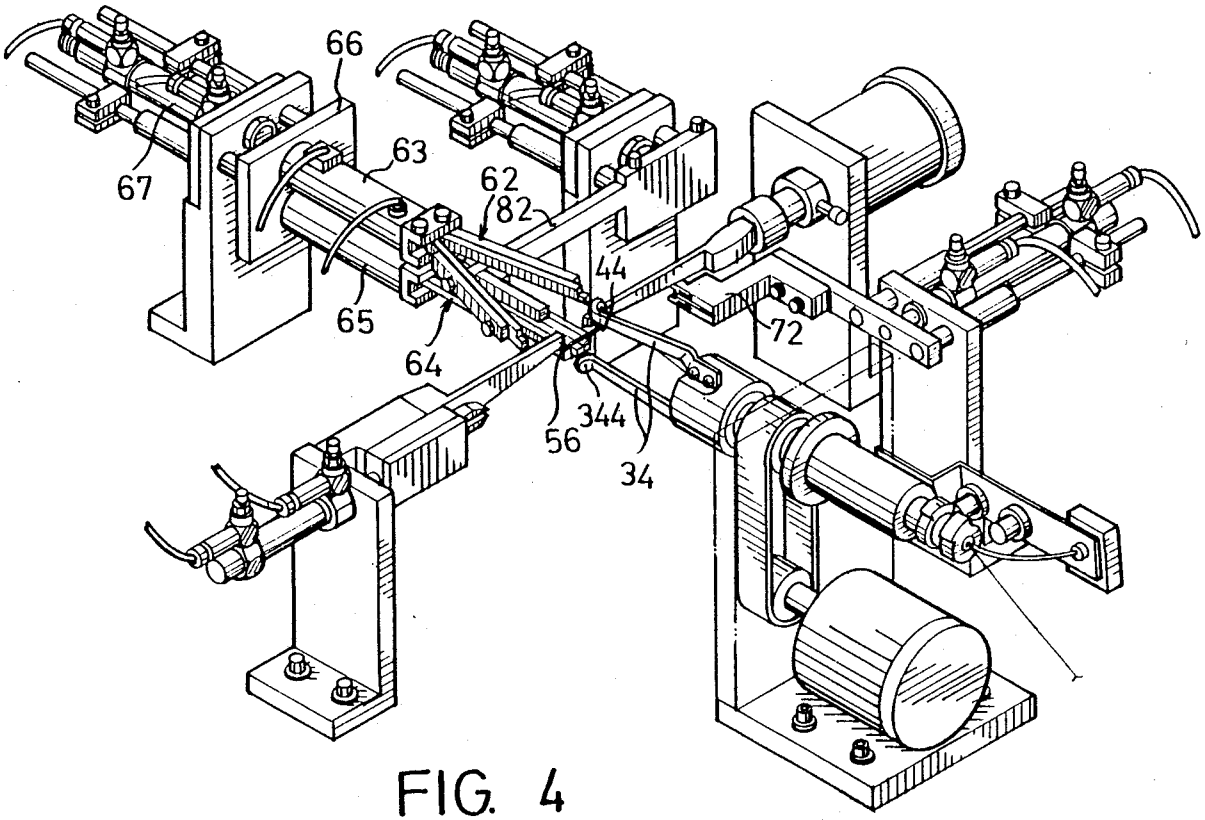
FIG. 4 is a different perspective view of the machine of this invention showing the wires wrapped, by a revolving drum, around respective protruding needles.

Referring now to the drawings, and more particularly to FIGS. 1, 2 and 4, there is shown a machine, generally designated with numeral 1, which incorporates the preferred embodiment of the present invention. Although the machine 1 shown in the drawings illustrates specific conventional driving means, per se, such as the motors and air cylinders, the present invention utilizes these driving means herein to achieve a new overall result.

As shown in FIGS. 1, 2 and 4, the machine 1 for manufacturing button connectors, in accordance with the present invention, comprises a wire supply means 10, a knurling means 20, a revolving drum means 30, a spinning means 40, a cutter means 50, a gripping means 60, a block plate means 70, and an ejection means 80.

The wire supply means 10 includes a spool 12 for mounting and supplying wire which is then guided to pass through a first suspended counterweight 14 pivotally attached to the wire supply means 10. The suspended counterweight 14 may be a known type for imposing desired tension on the wire. The spool 12 is rotatable. The wire supply means 10 also comprises a known type of step motor 18 which drives the spool 12, for example, by a belt 16, as shown in FIG. 1.

The knurling means 20 comprises a pair of knurling shafts 22. The wire coming from the wire supply means 10 is directed or fed to the knurling shafts 22 which knurl the wire passing therebetween. The knurled wire is further guided to pass through a second suspended counterweight 24 attached to the knurling means 20. It will be appreciated that only one of the knurling shafts 22 is driven; i.e., a step motor 28 incorporated therein drives one of the knurling shafts 22 by a toothed belt 26 or the like while the other knurling shaft 22 is idly driven. It is noted that the distance between the shafts 22, or the gap therebetween, is adjustable so that desired knurling effect is obtainable.

Figure 3:
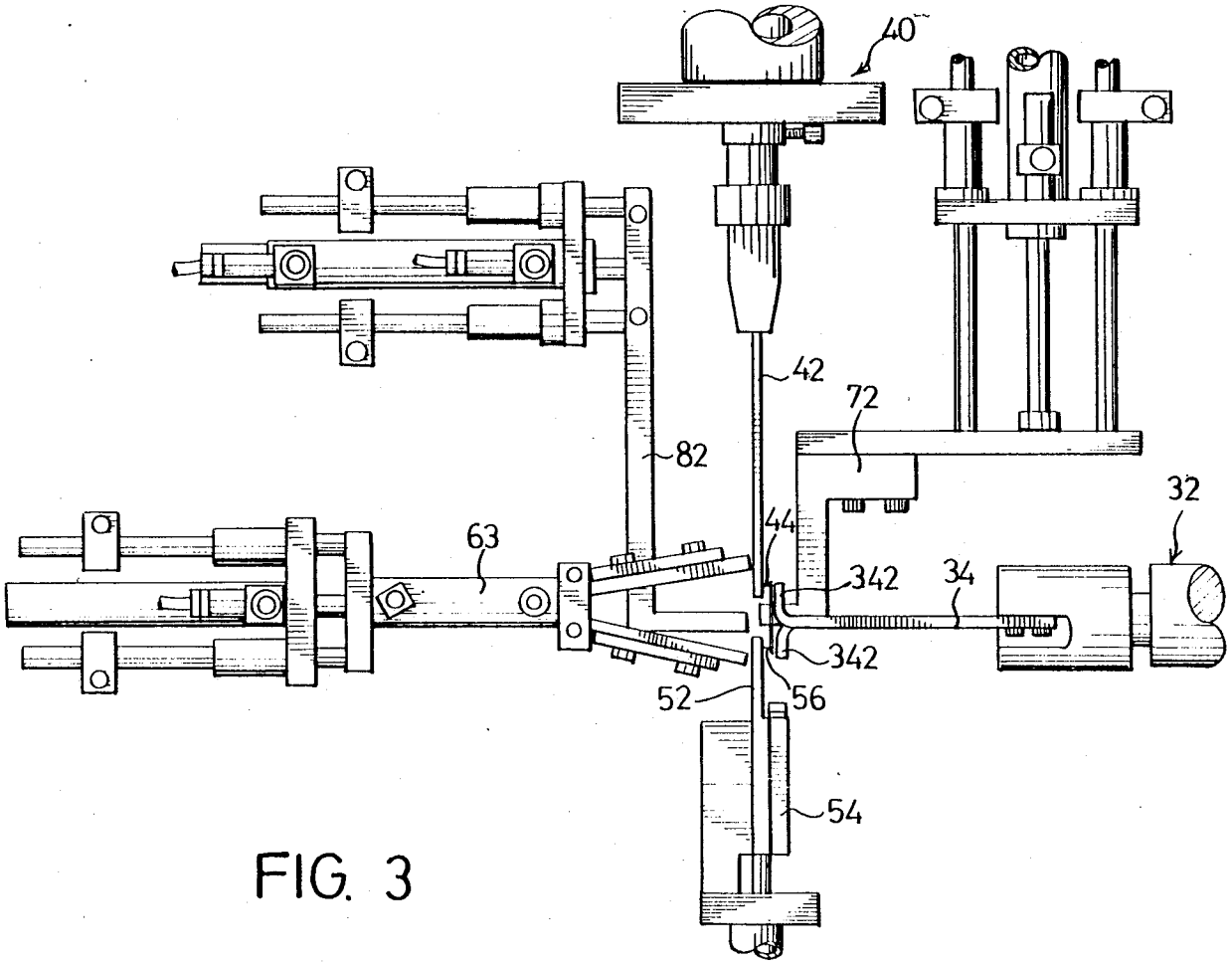
FIG. 3 is an enlarged view of FIG. 2 for showing the wire wrapped on protruding needles.

The revolving drum means 30 has a drum 32 which is held horizontally, or horizontally supported, by a vertical plate 38. The drum 32 has a center axis (shown in FIG. 1) and a pair of forks 34 longitudinally extending from one end (the end away from the knurling means 20) thereof. The forks 34 are circumferentially disposed at diametrically opposite ends. Each fork 34 has an inturned portion 342 formed at its end which is substantially perpendicular to the center axis of the drum 32 (as best seen from FIG. 3). FIG. 3 also shows the inturned portions 342 which turn to opposite directions for respective forks 34. The drum 32 has a first sensing means 36 at the other end for controlling the number of rotations of the drum 32. In this embodiment, the first sensing means 36 includes two control rings 362, 364 cooperating to control both the clockwise and counterclockwise rotations of the drum 32. A hole 344 is disposed on each fork 34 at the inturned portion 342 thereof, as best seen from FIG. 5.

The drum 32 has a central hollow portion 322. The wire from the knurling means 20 is guided through the central hollow portion 322 and selectively guided to pass through one of the holes 344. The drum 32 is driven to rotate by a motor 39. A belt 329 or the like can be disposed between the drum 32 and the motor 39 such that the drum 32 is rotatable by the motor 39.

The spinning means 40 has a spinning arm 42 extending in a direction substantially perpendicular to the drum 32 of the revolving drum means 30, as seen from FIG. 3. The spinning arm 42 has a first protruding needle 44 attached on one end thereof. The spinning arm 42 is rotatably supported and driven for example by a motor 48. The spinning means 40 further includes a second sensing means 46, shown only in FIG. 1, for controlling turns of rotation of the spinning arm 42.

The cutter means 50 includes a stationary arm 52 and a cutter 54 parallel to each other. The stationary arm 52 has a second protruding needle 56 attached on one end thereof for cooperating with the first extending needle 44 of the spinning arm 42. The wire passing through the hole 342 of the drum 32 is wrappable around the second protruding needle 56 and the first extruding needle 44 of the spinning arm 40 in response to the turning movement of the drum 32 of the revolving drum means 30. It should be noted that the spinning means 40 is actuated to spin or rotate an integral number of turns while the drum 32 of the revolving means 30 always revolves or rotates an integral and a half number of turns, when a cycle is performed, the direction of rotation for the revolving means 30 in the instant cycle is reversed with respect to the preceding cycle, i.e. the revolving means 30 alternately changes direction of rotation during the wrapping of the wire around the two needles 44, 56, such that the wire being knurled, and about to wrap around the pair of extending needles 44, 56, does not twist. As previously explained, the cutter 54 may be actuated by any known type of air cylinder 55.

The gripping means 60 has an upper gripper 62 and a lower gripper 64 thereon for firmly gripping the segment of the wire about to be wrapped around the extending needles 44, 56. The "segment" of the wire represents here the portion of the wire which is just cut relative to a preceding operation. In the subsequent description, the segment of the wire can represent the end portion of the wire which is formerly gripped. That is to say, the segment of the wire represents the portion of the wire adjacent to the wire being wrapped in a continuous state of the wire. As best shown in FIG. 4, the upper gripper 62 and the lower gripper 64 are designed to operate independently; i.e., the grippers 62, 64 may be actuated respectively for example by air cylinders 63, 65. As best seen from FIG. 5, each of the grippers 62, 64 is composed of a pair of gripping plates 622, 624 and 642, 644 respectively which are proximate to each other and pivotal about one end thereof. The grippers grip the segment of the wire with adjacent inner sides thereof. Both the grippers 62, 64 and the air cylinders 63, 65 may be supported by a plate 66 (best seen from FIG. 4) which is translatable and vertically disposed. The plate 66 is further actuated by any known type of air cylinder 67 which together with the two air cylinders 63, 65 is not a part of this invention, per se.

Figure 5:
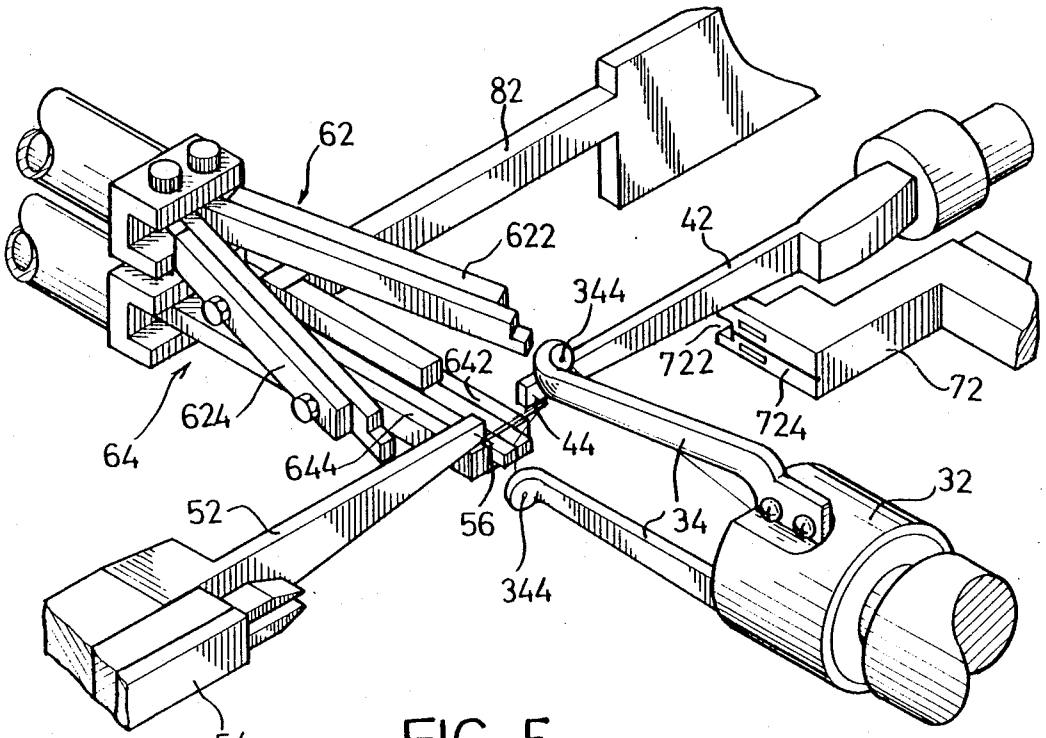
FIG. 5 is an enlarged view of FIG. 4 for showing the wire and relative positions of the elements of this invention.

The block plate means 70 has a horizontally protrudable block plate 72 thereon, as best seen from FIG. 5. The block plate 72, preferably made of plastic, has a slot 722, which is substantially parallel to the spinning arm 42 of the spinning means 40, so that the first protruding needle 44 of the spinning arm 42 can pass therethrough; i.e., the protruding needle 44 will not interfere with the protruding out of the block plate 72. The block plate 72 further has a plane surface 724 for the cutter 54 to cut the wire abutting the plane surface 724. It can be realized that the block plate 72 is preferably made of plastic materials or other suitable materials which will buffer the impact of the cutter 54 when performing cutting operation. The stationary arm 52 and the cutter 54 are independently actuated to operate. The cutter 54 is preferably spring cushioned to absorb an impact induced when the wire is cut between the cutter 54 and the plane surface 724 of the block plate 72. It is noted that, after the wrapped and spun wire is cut, one of the grippers grips the segment of the wire while the other of the grippers grips a disposable portion of the wire. A conventional air cylinder 73 is here utilized to actuate the protrusion or retraction of the block plate 72.

The ejection means 80 has a longitudinally slidable or protrudable ejector 82 thereon, as best shown in FIGS. 2 and 5. The ejector 82 is substantially L-shaped and is used for ejecting the wire, cut but still wrapped around the needles 44, 56, with end portion thereof. As shown in FIG. 1, a cover assembly 90 can be hinged to the vertical plate 38 and a conveyer means 96 can be disposed at a position substantially under the needles 44, 56 for receiving the wire which is ejected from the needles 44, 56 by the ejector 82.

The operations of the machine 1 of this invention will now be described with reference to the drawings and particularly to FIGS. 4 through 9.

FIG. 4 shows the wire being wrapped around the pair of needles 44, 56. The wire coming from the knurling means 20 is guided first to pass the central hollow portion 322 and one of the holes 344 on the inturned portions 342 of the forks 34. FIG. 4 also shows the end of the wire, or the segment, being gripped by one of the grippers 62, 64 (namely by the lower gripper 64 in FIG. 4). It is noted that, as shown in FIG. 4, the two segments of the wire are now respectively situated between the fork 34 and the first protruding needle 44 of the spinning arm 42, and between the lower gripper 64 and the first protruding needle 44. In order to better understand the above description, especially concerning the segments, a detailed enlarged view is shown in FIG. 5. As can be seen in FIG. 5, the cutter 54 comprises two complementary pieces each for cooperating with an upper or a lower portion of the plane surface 724 when performing the cutting operation. The two complementary pieces are used to simultaneously cut the two segments of the wire, i.e. the segment between the lower gripper 64 and the first protruding needle 44, as well as the segment between the upper gripper 62 (instead of the fork 34) and the first protruding needle 44.

Assuming that FIG. 5 shows a start-up position for the machine of the present invention, a free end of the wire passes through the hole 344 of the fork 34 which is situated uppermost, as illustrated in FIG. 5. This end of wire is gripped by the lower gripper 64. The fork 34 is initially situated lowermost (on the same side as the gripper 64 which grips the free end of the wire), such that after the revolving means 30 has revolved or rotated an integral and a half number of turns in accordance with the present method, the fork 34 will be situated uppermost (as shown in FIG. 5).

Figure 6:
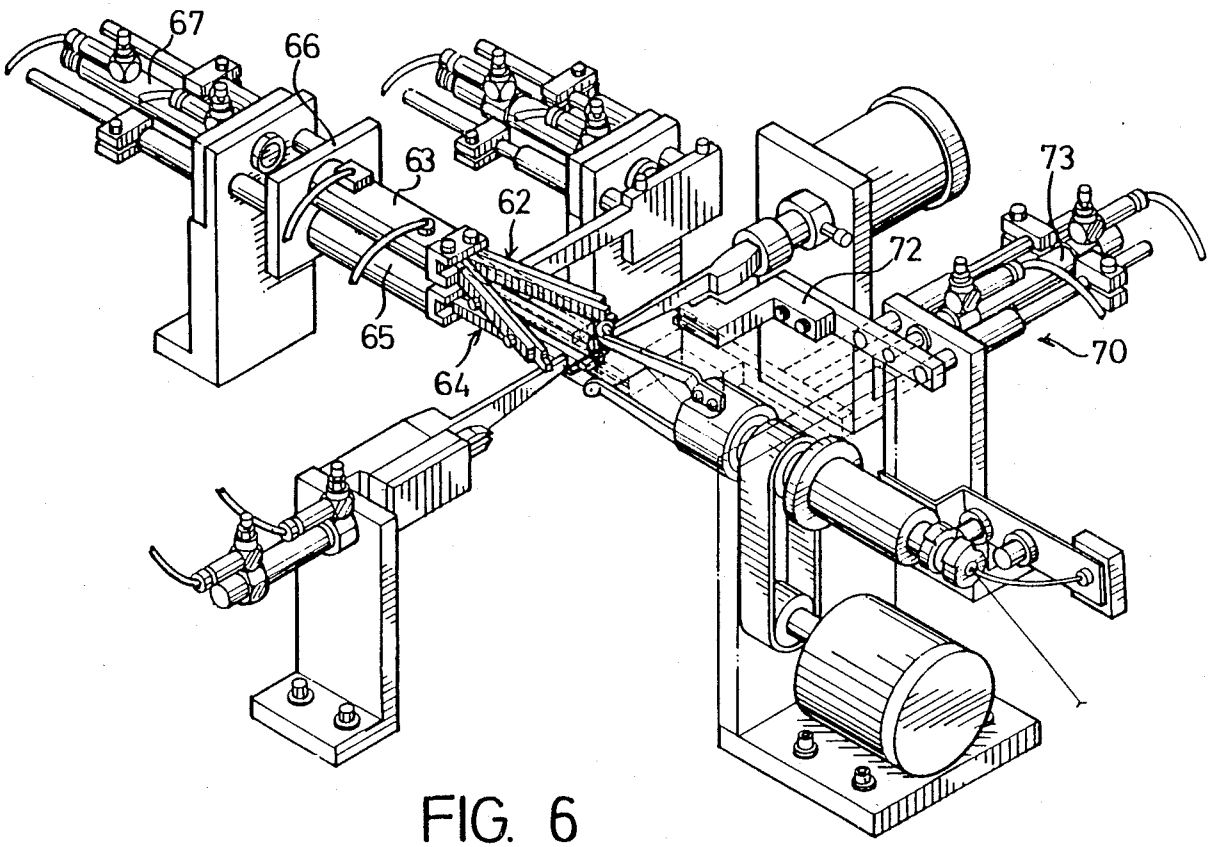
FIG. 6 is a view similar to FIG. 4, showing the upper gripper after actuation and a protruding block plate means.
Figure 7:
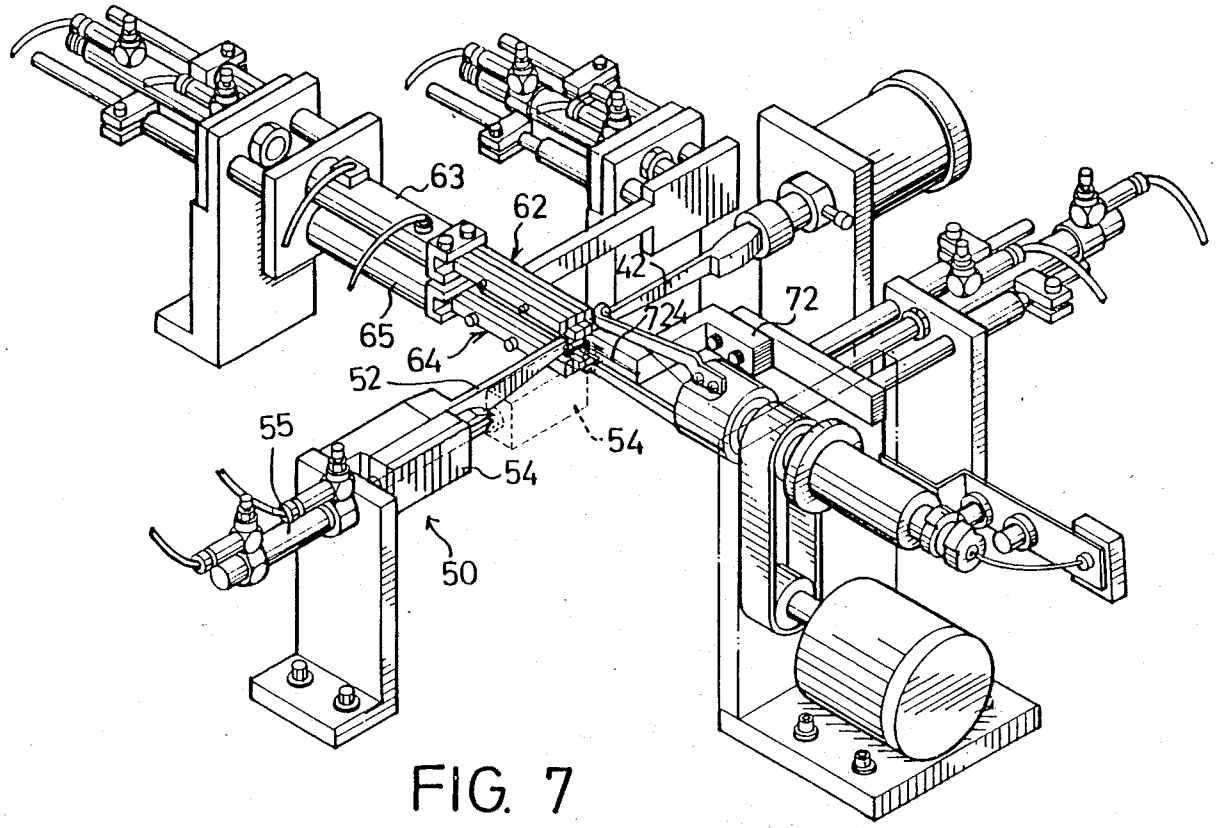
FIG. 7 is a view similar to FIG. 4, showing the wires on respective needles being spun and a cutter means being actuated to perform a cutting operation.

FIG. 6 shows the plate 66, and therefore the grippers 62, 64, being actuated to move toward the wire to grip the segment with the upper gripper 62 and the block plate 72 being actuated to protrude out such that the plane surface 724 (best seen from FIG. 5) thereof can cooperate with the cutter 54. FIG. 7 shows the configuration after completing the above-described operation.

FIG. 7 also shows the cutter 54 is about to protrude out to cut the wire at the segments. It is noted that, before the wire is cut, the spinning arm 42 of the spinning means 40 will be actuated to rotate about its own axis a specified integral number of turns. During this spinning operation of the spinning arm 42, the block plate 72 will not interfere with the first protruding needle 44 thereof. The spinning arm 42 is actuated to produce the coiled and twisted wire during its rotation about its axis. Then the "segment" of the wire between the fork 34 and the first protruding needle 44 is gripped, as shown in FIG. 7. The cutter 54 cuts two segments of wire, as was described above. After the cutter 54 performed its cutting operation, the newly created free end of wire is gripped by the other gripper, i.e. upper gripper 62, as opposed to the gripper 64 which initially gripped the free end of the wire.

Figure 8:
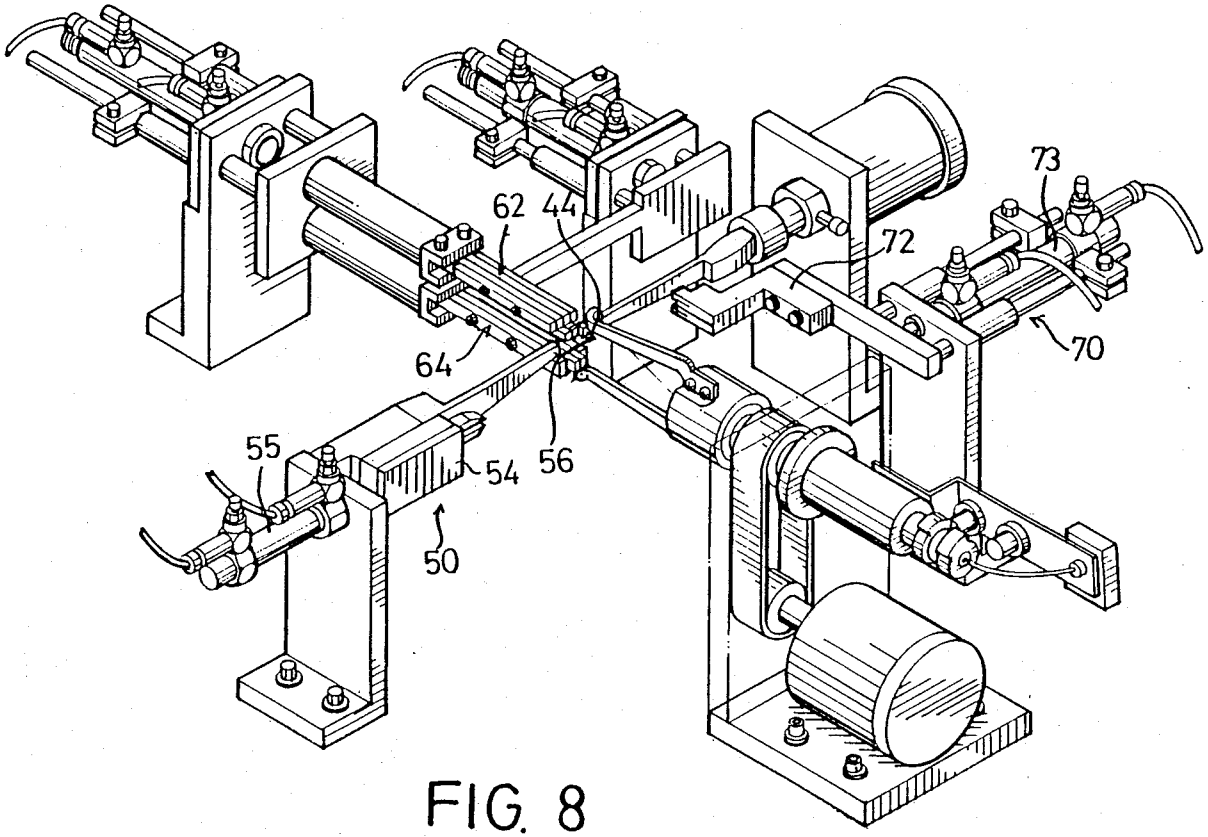
FIG. 8 is a view similar to FIG. 4, showing the wires being cut and both the block plate means and cutter means being retracted.

FIG. 8 shows, after the segment of the wires are cut, both the cutter 54 and the block plate 72 are retracted to their respective original or non-operative positions. At this moment the end of the wire is gripped by the upper gripper 62, which is different from the configuration shown in FIG. 4 wherein the end of the wire is gripped by the lower gripper 64. As mentioned above, the lower gripper 64 now grips the disposable portion of the wire.

Figure 9:
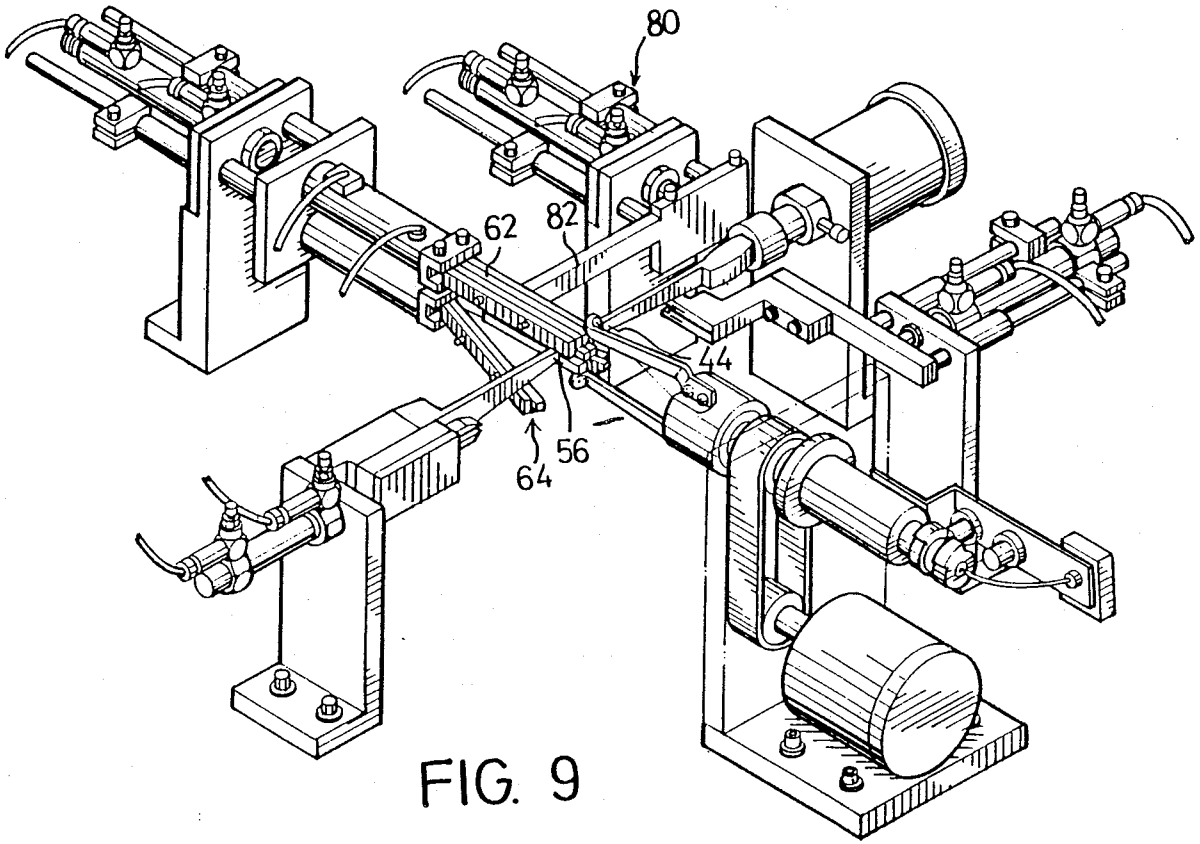
FIG. 9 is a view similar to FIG. 4, showing the twisted wires being extruded out by an extruder and a lower gripper being actuated to release.

FIG. 9 shows the wire, which has been knurled, wrapped and spun, being ejected from the needles 44, 56 by the extruder 82 of the extruding means 80. The conveyer 96, shown in FIG. 1 and 2, situated thereunder will receive or collect this ejected wire for further operation or treatment which is beyond the scope of this invention. When the grippers are retracted, a new cycle can be started. The direction of rotation for the revolving means 30 is now reversed with respect to the preceding cycle, i.e. the direction of rotation of revolving means 30 changes alternately during the wrapping of the wire around the two needles 44 and 56.

If the drum 32 of the revolving means 30 rotates unidirectionally, the wire on a whole will twist due to the portion of the wire per se passing through the central hollow portion 322 of the drum 32 and carried and rotated therewith. Therefore, two grippers cooperating with each other are needed.

While only one fork is used throughout the cycle of operation, two forks 34 are preferably provided for balance considerations, as well as for ease of manufacturing and operation, although disposing with either one of the two forks does not alter operation of the machine of the present invention in any substantial manner.

The method underlining the steps of the above operations are described hereinbelow with particular reference to FIGS. 10A through 10D.

The wire (FIG. 10A) used for producing button connectors, according to this invention, is first knurled to relieve or at least reduce internal stress for ease of treatment in subsequent operations. The knurled wire (FIG. 10B) then wraps around two temporarily stationary objects, for example the pair of needles 44, 56 in this embodiment, which define a distinct or specified distance. The wrapped wire (FIG. 10C) is further spun with reference to the line joining the two temporarily stationary objects such that the spun wire (FIG. 10D) is produced.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A machine for manufacturing button connectors, comprising:

(a) a wire supply means (10) having a rotatable spool (12) for mounting and supplying wire, the wire passing through a first suspended counterweight (14) pivotally attached to said wire supply means (10), said spool (12) being motor-driven;

(b) a knurling means (20) having a pair of rotatable knurling shafts (22) for knurling the wire pressing therebetween from said wire supply means (10); the knurled wire being guided to pass through a second suspended counterweight (24) attached to said knurling means (20), one of said knurling shafts (22) being motor-driven;

(c) a revolving drum means (30) having a rotatable drum (32) thereon, said drum (32) having a pair of forks (34) longitudinally extending from one end thereof, said drum (32) having a central hollow portion (322), a respective hole (344) being disposed on each of said forks (34), the wire from said knurling means (20) being guided through said central hollow portion (322) and selectively guided through one of said holes (344), said drum (32) being motor-driven;

(d) a spinning means (40) having a spinning arm (42), said spinning arm (42) having a first protruding needle (44) attached on one end thereof;

(e) a cutter means (50) having a motor-driven rotatable stationary arm (52) and a cutter (54), said stationary arm (52) having a second protruding needle (56) attached on one end thereof, the wire passing said hole (342) of said revolving drum means (30) being wrappable around said second protruding needle (56) and said first protruding needle (44) of said spinning arm (40);

(f) a gripping means (60) having an upper gripper (62) and a lower gripper (64) thereon for firmly gripping a segment of the wire;

(g) a block plate means (70) having a horizontally protrudable block plate (72) thereon, said block plate (72) having a slot (722) for said first protruding needle (44) of said spinning arm (42) to pass through and a plane surface (724) for said cutter (54) to cut the wire abutting said plane surface (724); and (h) an ejection means (80) having an ejector (82) thereon for ejecting the wire wrapped around said needles (44, 56).

2. A machine for manufacturing button connectors as claimed in claim 1 further comprising a cover assembly (90) and a conveyer means (96) for receiving the wire after ejection from said needles (44, 56) by said ejector (82).

3. A machine for manufacturing button connectors as claimed in claim 1 wherein another end of said drum (32) of said revolving drum means (30) further has a first sensing means (36) disposed thereon for controlling a number of turns of rotation of said drum (32).

4. A machine for manufacturing button connectors as claimed in claim 3, wherein said pair of forks (34) are disposed at diametrically opposite ends on said one end with respect to a center axis of said drum (32), each fork (34) having an inturned portion (342) substantially perpendicular to the center axis of said drum (32), said hole (344) being disposed on said inturned portion (342).

5. A machine for manufacturing button connectors as claimed in claim 1 wherein said spinning means (40) further comprises a second sensing means (46) for controlling a number of turns of rotation of said spinning arm (42).

6. A machine for manufacturing button connectors as claimed in claim 1 wherein said cutter (54) of said cutter means (50) is spring cushioned to absorb an impact resulting from cutting the wire between said cutter (54) and said block plate (72) of said block plate means (70).

7. A machine for manufacturing button connectors as claimed in claim 1 wherein said stationary arm (52) of said cutter means (50) is substantially coplanar with said spinning arm (42) of said spinning means (40), said needles (44, 56) thereof being longitudinally parallel to each other.

8. A machine for manufacturing button connectors as claimed in claim 1 wherein said grippers (62, 64) of said gripping means (60) alternately firmly grip the wire, grippers (62, 64) further comprising respective pairs of gripping plates (622, 624; 642, 644) proximate to each other and pivotal about one end thereof, said grippers (62, 64) gripping the wire with adjacent inner sides thereof.

9. A method for producing button connectors comprising the steps of:

(a) supplying wire to pass through a pair of knurling shafts (22);

(b) providing a motor rotatable hollow drum (32);

(c) guiding the wire through the motor rotatable hollow drum (32) and a hole (344) on one fork (34) of said drum (32);

(d) gripping a free end of the wire with an upper gripper (62) and wrapping the wire around first and second protruding needles (44, 56) respectively disposed on a spinning arm (42) of a spinning means (40) and a stationary arm (52) of a cutter means (50), said needles (44, 56) being longitudinally parallel to each other;

(e) revolving said drum (32) an integral and a half number of turns with respect to said needles (44, 56) and then actuating another gripper to also grip the wire;

(f) spinning the wire wrapped around said needles (44, 56) by spinning said spinning arm (42) an integral number of turns with respect to said second protruding needle (56), such that the wire becomes substantially helical-shaped;

(g) protruding a block plate (72) which has a plane surface (724) thereon for a cutter (54) to cut the wire abutting said plane surface;

(h) ejecting the wire wrapped around as needles (44, 56) and releasing said upper gripper (62).

10. A method for producing button connectors as claimed in claim 9 wherein said drum (32) alternately changes direction of rotation during wrapping of the wire around said needles (44, 56) by revolving said drum (32) so that the wire is not twisted.

* * * * *